United States Patent [19]

Sheets et al.

[11] 4,163,813

[45] Aug. 7, 1979

[54] METHOD OF PREPARING AND APPLYING ARTISTIC, DECORATIVE COMPOSITIONS

[76] Inventors: Nancy S. Sheets; James R. Sheets, both of 268 Foster Knoll, Joppa, Md. 21085

[21] Appl. No.: 827,728

[22] Filed: Aug. 25, 1977

Related U.S. Application Data

[63] Continuation-in-part of Ser. No. 679,927, Apr. 26, 1976, abandoned.

[51] Int. Cl.[2] ..... B05D 5/00

[52] U.S. Cl. ..... 427/198; 427/199; 427/200; 427/204; 427/205; 427/206; 427/257; 427/258; 427/264; 427/270; 428/155; 428/195

[58] Field of Search ..... 427/198, 199, 200, 204, 427/205, 206, 258, 264, 270, 257; 428/141, 143, 523, 151, 155, 149, 325

[56] References Cited

U.S. PATENT DOCUMENTS

| | | | |
|---|---|---|---|
| 78,991 | 2/1868 | Montier | 427/202 X |
| 949,819 | 2/1910 | Cohn | 427/202 X |
| 1,580,921 | 4/1926 | Scherer | 427/202 X |
| 1,607,928 | 11/1926 | Harris | 427/258 X |
| 1,765,981 | 6/1930 | Kathe | 427/258 X |
| 1,807,291 | 5/1931 | Jackson | 427/205 X |
| 1,989,089 | 1/1935 | Errante | 427/257 |
| 1,991,996 | 2/1935 | Bakker | 427/205 X |
| 2,104,790 | 1/1938 | Casto | 427/202 X |
| 2,339,317 | 1/1944 | Ayers | 427/204 |
| 2,350,818 | 6/1944 | Rees | 427/202 |
| 2,763,079 | 9/1956 | Slovitt | 427/205 X |
| 3,142,580 | 7/1964 | Holoubek et al. | 427/205 |
| 3,192,063 | 6/1965 | Donofrio | 427/204 |
| 3,692,557 | 9/1972 | Sormani | 427/258 X |
| 3,971,692 | 7/1976 | Anderson | 427/258 X |

FOREIGN PATENT DOCUMENTS

| | | | |
|---|---|---|---|
| 24940 | of 1908 | United Kingdom | 427/200 |
| 227202 | 1/1925 | United Kingdom | 427/200 |

*Primary Examiner*—Shrive P. Beck

*Attorney, Agent, or Firm*—Nancy A. Coleman

[57] ABSTRACT

Farinaceous material and water are mixed in proper proportion, applied to panels to be decorated and/or protected in desired designs or embedded with various inert materials, and then dried. The coating material cracks, then it is stained and coated with shellac, lacquer or varnish to give further protection. After staining, the coating material has the appearance of inlaid stone.

7 Claims, No Drawings

METHOD OF PREPARING AND APPLYING ARTISTIC, DECORATIVE COMPOSITIONS

The present application is a continuation-in-part of our United States patent application Ser. No. 679,927, filed Apr. 26, 1976, now abandoned.

SUMMARY OF THE INVENTION

The present invention relates to decorative compositions, and more particularly to decorative, protective and realistic coatings and a method for preparing and using the same on wood, wall board, construction insulation board, sheeting, and other surfaces. An object of this invention is to provide a new and improved coating material, which is artistic, and decorative and realistic as well as useful on wood panels, construction insulation board, other types of building boards, panels and tile. Another object of this invention is to provide a new artistic, decorative and realistic coating which can be applied by any of several different methods as well as new and improved processes for making and using the same. It will be apparent to those skilled in the art that this invention is extremely inexpensive and economical to manufacture and use; is easily and readily manufactured; utilizes common and readily available starting materials; is easily provided with different colors and finishes; is stable and easily stored and transported; and is flexible and chip resistant. A further object of this invention is the elimination of cellulose as a filler or plasticizer in decorative coatings, and the incorporation of various inert items, such as aluminum shavings, sand, finished pieces of wood, string, twigs, bits of cloth, seashells, leather pieces, cork, vinyl or vinyl asbestos, small pieces of mirrors and similar items for an overall decorative effect, which provides a new and improved decorative and protective coating. A particular feature of this invention is the use of a controlled cracking process to enhance the desired effects in the decorative composition. This allows the decorative composition to be stained any of several desirable colors in several shades without a multiplicity of coats. These and other objects of the present invention will become apparent to those skilled in the art from a consideration of the detailed description, which follows, of the preferred embodiments of the invention.

DETAILED DESCRIPTION

The protective and decorative compositions of this invention are prepared and applied to any of several surfaces, such as construction insulation board, wood, wall board, sheeting and similar panels. A preferred embodiment of this invention uses construction insulation board, which is readily obtainable. Most construction insulation board comes with one side colored black and the other colered tan or off white. Either side may be used, but we have found that the black side is most satisfactory. No pretreatment of the panel is required, except to cover up manufacturer's markings with a black, solvent-based drawing ink such as that sold commercially under the trade name "Magic Marker." If wood sheets are used as the backing, they may be sanded and stained beforehand, if desired, although that is not necessary.

We prefer to use a farinaceous material, such as starch, wheat or corn flour or the like, for the basis of our invention. Such material forms the basis of an excellent adhesive. What has always been a problem heretofore is the need to add a plasticizing material, such as cellulose, to the adhesive to give it body, and enable it to be worked. Another problem has been the coloring or dyeing of the material. It has always been necessary to color the material before it was applied to the backing, thus obtaining only a uniform color. It has been impossible to shade or otherwise obtain a non-uniform color. Another use of the plasticizer has been to prevent the peeling and breaking off of pieces of the coating as it dried. Use of certain types of cellulose, such as straw, has given coatings which were prone to being rubbed off easily, in addition to the problem of breaking off.

We have found that an adhesive made of ordinary wheat flour and water is excellent for carrying out our invention. A mixture of one cup of warm water and one and one-half cups of flour is prepared. No boiling or further heating is necessary. The mixture is stirred to a slightly lumpy consistency, although no lumps of flour should remain. The ratio of one and one-half cups of wheat flour to one cup of water is a preferred method of our invention. At this ratio we have found that the material is easily handled, does not drip or run, and needs no draining before use.

After the coating material is prepared, it is applied to the backing described hereinabove. The application is made with a putty knife, palette knife, trowel or similar article or with the hands. No attempt is made to keep the coating regular in depth, thus giving rise to a "hills and valleys" effect. After application to the surface or backing, including the sides, to be decorated, the material may be shaped and worked by hand or with a suitable implement, such as a palette knife, depending upon the results desired. The material may be pulled into a thin layer, or alternatively, pushed into a thick one. Various portions of it may be cut away with the palette knife, thus forming designs in silhouette. A more difficult method of application is to apply small amounts of the material at a time, thus completing any desired design. The material may be further shaped after this latter method of application into thin or thick layers, thus giving rise to a shading effect. Further, it has been found that realistic patterns can be made in the medium. For instance, faces can be prepared, as well as scenes, woodland, animals, people and so forth.

If desired, the entire panel is covered with the coating material, and then it is shaped in a more or less irregular manner as described above. While it is still wet, various items may be embedded in the material for decorative as well as realistic effects. We have found that aluminum shavings, cork, driftwood, finished pieces of wood, string twigs, shoelaces, sands, pebbles, seashells, bits of leather, small peices of mirror, vinyl and asbestos vinyl, among others, can be embedded in the material in various designs. The materials used will depend, more or less, upon the effect desired, and our invention is not limited to the use of any one of them. All are suitable, and will adhere to the coating material without further treatment. The realistic patterns mentioned above can be highlighted or enhanced by the insertion of small mirrors in a realistic manner. For instance, the horns on antelope, jewels in a turban, snails against a background, birds flying or the hair surrounding a face can be realistically depicted by the strategic placement of mirrors. The effect of such enhancement is not unlike the realistic effects of Romantic Era artists using oil based paints.

The backing to which the material has been applied is then set aside to dry. The length of time required and the temperature used depends upon the depth of the coating and the size of the cracks desired. We have found that simple air drying at about 65° F. for a period of 48 to 72 hours produces very satisfactory results. Alternatively, the panels may be oven dried or placed outside in the sun. Close attention must be paid to the panels during the drying process, however, as it is possible to dry them too little. It has been found that when the material is dry, not tacky, to the touch overall, with a little sponginess in the thicker areas, that the panels are ready for the next step. Also, care must be taken during the drying process to prevent warping of the backing.

During the drying process, minute cracks begin to appear. It has been found that the width and depth of the cracks can be controlled by the depth of the coating material and the length of time that it is dried. Thin layers of the coating material result in many small cracks during the drying process, while thicker layers result in fewer, but deeper and wider cracks. After the panels are dry to the touch, but still spongy in the thicker areas, an oil base wood stain is applied by brush or other means. An area approximately one foot square can be covered at one time. After the application of the wood stain, the coating material is wiped rapidly with an absorbent cloth. The stain settles into the cracks and is quickly taken in by the coating material, so it is imperative that the wiping proceed promptly before the coating material becomes too dark. Should the resulting color not be dark enough, a second coat of stain may be applied at the desire of the operator. It has been found that small cracks in a thin layer tend to become darker during the staining process than the larger cracks in the deeper layers. Furthermore, it has been discovered that an almost white look is obtained if the coating stain is wiped immediately after application with a rag soaked in a volatile solvent, such as gasoline, turpentine, acetone or the like. It has been found that the varied process of absorption of the coloring matter described hereinable results in a most interesting decorative effect. This process, therefore, gives rise to coating material which is not uniform in color, an effect which was previously unobtainable.

It is the controlled cracking process which is the heart of our invention. Before now, every effort has been made to prevent cracking, because this caused the coating to peel and break off. We have discovered how to control the cracking process so that the material will adhere to the backing and not peel off. The cracking is controlled by the ratio of wheat flour to water in the material, the depth of application and the length of time the panels are dried. Use of common filler material such as ground paper or wood pulp has heretofore been thought necessary to keep the material on the backing without shrinking and losing adherence. It was also thought necessary to use a preliminary layer of adhesive or a glue in the material itself to promote adherence by using the present invention, these troublesome problems have been eliminated. The use of farinaceous material as an adhesive has been known to those skilled in the art for years. But no one, until this invention, has prepared material with the opposite effect, i.e. controlled cracking, using essentially the same starting materials.

After the stain has dried, the panels may be coated with a suitable shellac, lacquer, varnish, or similar material. This coating varnish is preferably clear, although a tinted one can be used, if desired. It has been found that a clear, urethane based varnish gives a particularly desired result, although other types, as aforesaid, may be used. The varnish may be applied by spray, brush, or other suitable means; although if mirrors are embedded in the coating material, it is better to apply the varnish, shellac or lacquer with a brush rather than as a spray, as it is difficult to remove excess spray from the mirrors. If desired, two or three coats of the shellac, varnish, or lacquer may be applied, thus giving a heavier coating to the material. Panels thus protected are impervious to chipping, peeling, flaking or impact. Panels prepared according to our invention have the look of inlaid stone, thus being most decorative as well as functional. If desired, the panels may be further enhanced by the application of highlights by painting or drawing on them with colored inks or paints.

Certain modifications and changes to the preferred form of the invention disclosed hereinable may occur to those skilled in the art to which the invention pertains. Therefore, the scope of the claims is not restricted to that disclosed above but to the practices obvious to one skilled in the art.

We claim:

1. In a process for the coating of a surface with a decorative coating which comprises the steps of mixing a farinaceous material with water in a ratio of one cup of water to one and one-half cups of farinaceous material to form an adhesive, said adhesive consisting essentially of farinaceous material and water, applying said adhesive to a backing material in irregular depth with suitable means; embedding inert material in a random pattern in the coating; the improvement of controlled drying at a temperature of 65 degrees F. for a period of 48 to 72 hours to produce a cracked surface, followed by the steps of coating the surface with a stain and a varnish.

2. A process according to claim 1, wherein the farinaceous material is wheat flour.

3. A process according to claim 2, wherein the backing material is construction insulation board.

4. A process according to claim 3, wherein the inert material is small pieces of mirrors.

5. A process according to claim 4, wherein the inert material is cork.

6. A process according to claim 3, wherein the inert material is pieces of leather.

7. A process according to claim 3, wherein the inert material is pieces of wood.

* * * * *